US006193408B1

(12) United States Patent
Miura et al.

(10) Patent No.: US 6,193,408 B1
(45) Date of Patent: Feb. 27, 2001

(54) MIXER

(75) Inventors: Satoru Miura, Yashio; Yuichi Hirooka, Sodegaura, both of (JP)

(73) Assignee: Yoshino Gypsum Co., Ltd., Tokyo (JP)

( * ) Notice: Subject to any disclaimer, the term of this patent is extended or adjusted under 35 U.S.C. 154(b) by 0 days.

(21) Appl. No.: 09/340,662

(22) Filed: Jun. 29, 1999

(30) Foreign Application Priority Data

Mar. 19, 1999 (JP) ..... 11-076848

(51) Int. Cl.[7] ..... B01F 7/16; B01F 7/26

(52) U.S. Cl. ..... 366/304; 366/317

(58) Field of Search ..... 366/304, 317, 366/302, 303, 307, 315; 241/188.2, 188.1, 191, 195, 242, 243, 261, 296

(56) References Cited

U.S. PATENT DOCUMENTS

| | | | | |
|---|---|---|---|---|
| 32,250 | * | 5/1861 | Jackson | 366/317 |
| 1,576,472 | * | 3/1926 | Riley | 241/188.2 |
| 1,758,200 | | 5/1930 | Pfeffer et al. . | |
| 1,854,732 | * | 4/1932 | Beran | 366/304 |
| 2,039,264 | * | 4/1936 | Seckendorfff | 241/188.2 |
| 2,253,059 | | 8/1941 | Camp . | |
| 2,338,373 | * | 1/1944 | Aurig | 241/188.2 |
| 2,623,700 | * | 12/1952 | Scherer | 241/188.2 |
| 2,639,901 | * | 5/1953 | Teale | 366/317 |
| 2,660,416 | | 11/1953 | Camp et al. . | |
| 3,459,620 | | 8/1969 | McCleary et al. . | |
| 4,176,972 | | 12/1979 | Stiling . | |
| 4,691,867 | | 9/1987 | Iwako et al. | 366/304 |
| 4,995,729 | | 2/1991 | Eberhardt et al. . | |
| 5,791,571 | * | 8/1998 | Hijikata | 241/188.2 |

FOREIGN PATENT DOCUMENTS

| | | | | |
|---|---|---|---|---|
| 143999 | * | 7/1935 | (DE) | 366/304 |
| 3611048 | | 10/1987 | (DE) . | |
| 205548 | * | 10/1923 | (GB) | 366/304 |
| 310701 | * | 5/1929 | (GB) | 366/304 |
| 63-45611 | | 9/1988 | (JP) . | |
| 06164052 | | 7/1994 | (JP) . | |
| 8-25342 | | 1/1996 | (JP) . | |
| 10-323550 | | 12/1998 | (JP) . | |

* cited by examiner

*Primary Examiner*—Tony G. Soohoo
(74) *Attorney, Agent, or Firm*—Griffin & Szipl, P.C.

(57) ABSTRACT

A mixer 10 comprises a disc 32 having peripheral edge 35, which is formed in a circular profile concentric with inner circumferential surface 25 of annular outer wall 23; lower pins 50 provided with rear bulged portions 73 extend backward of the rotational direction R; and upper pins 60 provided with front bulged portion 72' which extends forward of the rotational direction. A disc without a toothed formation on its peripheral edge zone can prevent the slurry from depositing on the outer periphery of the disc. Front and rear bulged portions 72', 73 occupy a rearward area of the lower pin and a forward area of the upper pin so as not to provide retentive regions for the slurry, which might otherwise have caused a vortex or turbulent flow of the slurry. Accordingly, the deposition of slurry on the lower and upper pins can be prevented from occurring.

24 Claims, 10 Drawing Sheets

(A)

(B)

(A)

(B)

MIXER

FIELD OF THE INVENTION

The present invention relates to a mixer, and more specifically, to a gypsum slurry mixer for mixing and agitating ingredients including calcined gypsum with a quantity of water and feeding gypsum slurry to a successive step, such as a step of disposing the slurry between paper cover sheets.

BACKGROUND OF THE INVENTION

Various kinds of gypsum boards having a gypsum core covered with paper sheets are generally in practical use for architectural interior finish work or the like. In general, a process of producing such a gypsum board includes steps of admixing a quantity of water and foam with ingredients for the gypsum core, such as calcined gypsum, an adhesion promoting agent, a set accelerator, additives, intimate mixtures and the like, so as to produce a gypsum slurry; disposing the gypsum slurry between paper cover sheets to form a continuous web of gypsum board; generally shaping and setting the web in a predetermined outline of a board; and further, severing and drying it and finally cutting the boards in a predetermined size of the gypsum board product.

A thin, circular mixer is generally used as a mixer for admixing the aforementioned materials for the gypsum boards. This kind of mixer comprises a flattened cylindrical housing or casing, and a rotary disc to be rotated within the housing in operation of the rotary drive means. An upper cover plate of the housing is provided at its central area with a plurality of inlet ports for introducing the feedstock materials into the housing and the housing is provided in its peripheral zone with a slurry outlet port for discharging the gypsum slurry therethrough.

In the conventional mixers, the rotary disc is formed with a serrated or toothed peripheral edge for displacing the gypsum slurry radially outward. On the rotary disc, a plurality of lower pins are fixed to project therefrom, which define movable pins, whereas a plurality of upper pins are supported by the upper cover plate to depend therefrom, the upper pins defining stationary pins. The lower and upper pins are alternately arranged in a radial direction of the disc and are moved relative to each other during rotation of the disc to cooperate with each other so as to agitate and admix the ingredients with the water in the housing. The rotating disc allows the gypsum slurry to be discharged through the slurry outlet port so as to be fed to the following slurry-disposing step.

This kind of pin mixer is disclosed, e.g., in Japanese Patent Laid-Open Publication No. 8-25342. FIG. 9 is a fragmentary perspective view, partly broken away, illustrating an internal structure of the pin mixer, and FIGS. 10(A) and 10(B) are side elevational and transverse cross-sectional views illustrating structural arrangements of lower and upper pins as shown in FIG. 9.

As shown in FIG. 9, the rotary disc D located within the housing H has the peripheral edge with a plurality of tooth elements G, the respective tooth elements G being circumferentially spaced apart a constant distance. The lower pin P1, which is fixed on the disc to protrude therefrom vertically upward, is configured in the form of round column with a uniform cross-sectional profile throughout its entire height. The upper cover plate C of the housing H is provided with the upper pins P2 fixed thereto and depending therefrom, which are configured in a form of a round column substantially identical with that of the lower pin P1.

During rotation of the disc D, the lower pin P1 moves in the direction of rotation R, and the front surface thereof facing forward as seen in the rotational direction R propels and displaces the gypsum slurry so that a counter-flow of the slurry or ingredients relative to the pin P1 is formed to move backward with respect to the rotational direction R. A vortex or turbulent flow zone, which represents a transitional retentive state of the slurry, is provided behind the pin P1, so that the slurry to be fluidized by mixing action tends to deposit on and adhere to the rear surface of the pin. The deposition of the slurry behind the pin P1 develops or grows gradually as the mixing and agitating operation is continuously in progress. The set accelerating action of the set accelerator contained in the ingredients affects and additionally promotes such a deposition of slurry, and thus, a relatively large mass S of the slurry is formed on the rear surface of the pin P1 as shown in FIG. 10.

An analogous condition can be observed in the upper pin P2 as shown in FIG. 10(A), and also, it appears on the toothed elements G in the toothed peripheral edge of the disc D. The recess or cavity formed between the respective tooth elements G, which is a so-called "dead space", temporarily receives the slurry and acts to propel or displace the slurry into the slurry outlet port. The slurry retentively trapped in the dead space, however, tends to set therein and deposit on the tooth element G. The deposition of slurry in the dead space further develops or grows, owing to the set accelerating action of the set accelerator or the like, so that a relatively large solid mass of slurry adheres to the tooth element.

These kinds of solid mass deteriorate the fluidity of the ingredients and slurry within the mixer, and degrades the mixing performance of the mixer, and an excessive growth of the solid mass of slurry during continuous operation of the mixer may result in an irregular load distribution of the disc, which may generates microvibration of the disc accompanied by partial removal or separation of the solid mass. The removed pieces or sections are fed to the following slurry-disposing step together with the gypsum slurry to be contained in the gypsum core of the gypsum board. In the gypsum board containing such foreign matter or impurities, a failure or defectiveness of product quality, such as a local depression or recess on the gypsum board, is apt to appear on the surface of the board product, and this kind of failure results in a degradation of the production efficiency or actual yield of production. Thus, an improvement for surely preventing such a failure is desired.

It is an object of the present invention, therefore, to provide a pin mixer having a simplified arrangement that surely prevents a solid mass of slurry from depositing on a pin or a toothed edge of a rotary disc.

SUMMARY OF THE INVENTION

The present invention provides a mixer comprising a housing into which a powdered material and a quantity of water is introduced, a rotary disc rotatably mounted within the housing, a plurality of lower pins fixedly secured on the disc, and a plurality of upper pins fixedly secured on a lower surface of an upper cover of the housing, so as to admix and agitate the powdered material with the water to produce a gypsum slurry, wherein a peripheral edge of said disc is configured to be a circular profile concentric with a circumferential inside wall surface of an annular outer wall of said housing.

According to the present invention, the slurry in the housing is radially urged toward a discharge port by coaction of the rotational and centrifugal forces of the disc and fluidization of the slurry resulting from admixing and agitating action of the intermeshing pins. A dead space or retention region of the slurry is not provided in the peripheral zone of the disc, and therefore, a solid mass is not produced in the peripheral zone of the disc.

The present invention also provides a mixer comprising a housing into which a powdered material and a quantity of water is introduced, a rotary disc rotatably mounted within the housing, a plurality of lower pins fixedly secured on the disc, and a plurality of upper pins fixedly secured on a lower surface of an upper cover of the housing, so as to admix and agitate the powdered material with the water to produce a gypsum slurry, wherein said lower pin is provided with a rear bulged portion expanding rearward in a rotational direction of the disc, said bulged portion extending rearward in the rotational direction so as to allow the slurry to move backward along lateral surfaces of said lower pin to join together behind the lower pin.

According to this arrangement of the present invention, the lower pin is provided with the rear bulged portion, and the region behind the lower pin, in which vortex or turbulent flow of slurry may be caused, is eliminated. Therefore, the slurry flowing or moving to the region behind the lower pin does not substantially deposit on the lower pin, and therefore, the growth or development of a solid mass of the slurry on the rear face of the lower pin is avoidable.

From another aspect of the present invention, this invention provides a mixer comprising a housing into which a powdered material and a quantity of water is introduced, a rotary disc rotatably mounted within the housing, a plurality of lower pins fixedly secured on the disc, and a plurality of upper pins fixedly secured on a lower surface of an upper cover of the housing, so as to admix and agitate the powdered material with the water to produce a gypsum slurry, wherein said upper pin is provided with a front bulged portion expanding frontward in a rotational direction of the disc, said bulged portion extending frontward in the rotational direction so as to allow the slurry to move forward along lateral surfaces of said upper pin to join together in front of the upper pin.

In accordance with this arrangement of the present invention, the upper pin is provided with the front bulged portion, and the region in front of the upper pin, in which vortex or turbulent flow of slurry may be caused, is eliminated. Therefore, the slurry flowing or moving to the region in front of the upper pin does not substantially deposit on the upper pin, and therefore, a solid mass of the slurry on the front face of the upper pin can be prevented from growing or developing.

Preferably, the lower and/or upper pin has a pair of lateral surfaces defining planes substantially parallel to the rotational direction of the disc, and angled surfaces inclined to the lateral surfaces at a predetermined angle to extend rearward and/or frontward of the rotational direction, wherein the angled surfaces on both sides in pair are jointed to each other at a predetermined angle to form the rear bulged portion or front bulged portion. More preferably, the lower and/or upper pin has a cross-sectional profile formed in a hexagonal configuration which is elongated in the rotational direction of the disc and symmetric with respect to the axis extending in the rotational direction.

In one preferred embodiment, the lower and/or upper pin is provided with a pair of left and right curved surfaces, each having a predetermined radius of curvature. The curved surface extends from the part of the pin having a maximum dimension in a direction perpendicular to the rotational direction, and the cross-sectional profile of the curved surface is configured in a parabolic shape or streamlined shape. The curved surfaces are jointed to each other in the rear or front area in the rotational direction to form the rear or front bulged portion. Preferably, the cross-sectional profile of the lower or upper pin is generally configured to be an ellipse that is elongated along the rotational direction and symmetric with respect to the rotational direction.

In another preferred embodiment, the rotary disc is a metallic disc, preferably an iron or steel disc, an upper surface of which is covered with a wear-resistant material. More preferably, the pin comprises a metallic body in a form of column with the cross-sectional profile being uniform throughout the entire height, and securing means for fixedly securing the body on the rotary disc or the housing, such as a thread portion. The pin may be detachably secured on the disc or the housing.

BRIEF DESCRIPTION OF THE DRAWINGS

These and other objects and advantages will become more readily apparent when considered in relation to the preferred embodiments as set forth in the specification and shown in the drawings in which.

DETAILED DESCRIPTION OF PREFERRED EMBODIMENTS

Figure 1:
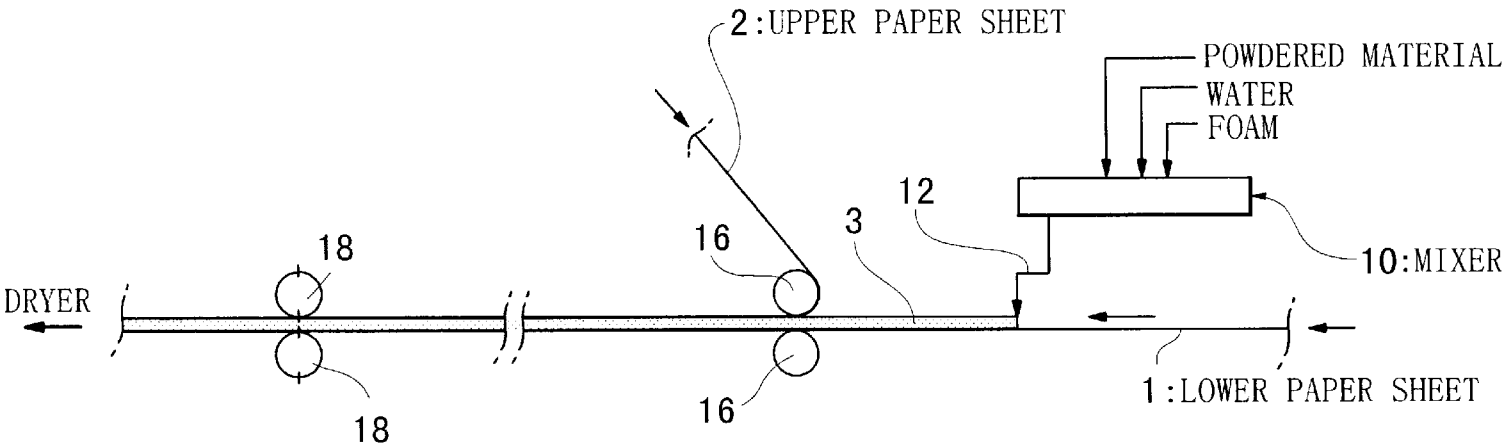
FIG. 1 is a schematic illustration diagrammatically and partially showing a process for producing gypsum boards.

Referring now to FIG. 1, there is generally illustrated a process for producing gypsum boards.

The process for producing gypsum boards comprises a mixing step of admixing ingredients of gypsum board core with a quantity of water and foam, the ingredients including calcined gypsum, adhesion promotion agent, set accelerator, additives, intimate mixtures and the like; a slurry feeding step of depositing a quantity of gypsum slurry between upper and lower paper cover sheets for gypsum board; and drying/setting/cutting step of shaping and severing a continuous web of gypsum board to manufacture gypsum boards of a predetermined configuration.

A mixing and agitating apparatus or mixing device 10 (referred to as a mixer 10 hereinafter) is located above a conveyor which transfers a continuous lower paper sheet 1 for gypsum board. The powdered materials, such as calcined gypsum, adhesion promotion agent, set accelerator, additives, intimate mixtures and the like, a quantity of foam and a liquid material (a quantity of water) are respectively introduced into the mixer 10, which mixes and agitates these materials and discharges a gypsum slurry 3 onto the lower paper sheet 1 through a slurry feed conduit 12.

The slurry 3 is carried with the lower paper sheet 1 on the conveyor and reaches a pair of forming rollers 16. A continuous sheet of upper paper 2 for gypsum board is fed to the rollers 16, the upper roller of which diverts the paper sheet 2 toward the conveying direction and allows the sheet 2 to be overlaid on the slurry 3. The continuous web of a three-layer formation, which comprises the lower paper sheet 1, slurry 3 and upper paper sheet 2, is shaped by guide means or the like while transferred on the conveyor, and while the setting reaction of the slurry progresses. The continuous web on the conveyor is severed by a set of severing rollers 18 so as to have an approximate preset length of the gypsum board, whereby a board comprising a gypsum core covered with the paper sheets is formed as a gypsum board material. Further, the board materials are forcedly dried through a dryer (not shown), and if desired, they are finally cut so as to have a predetermined product size, and thereafter, delivered or transported as gypsum board products.

FIGS. 2 through 6 are a plan view, perspective view, fragmentary perspective view, vertical cross-sectional view and horizontal cross-sectional view, respectively of the mixer 10.

Figure 2:
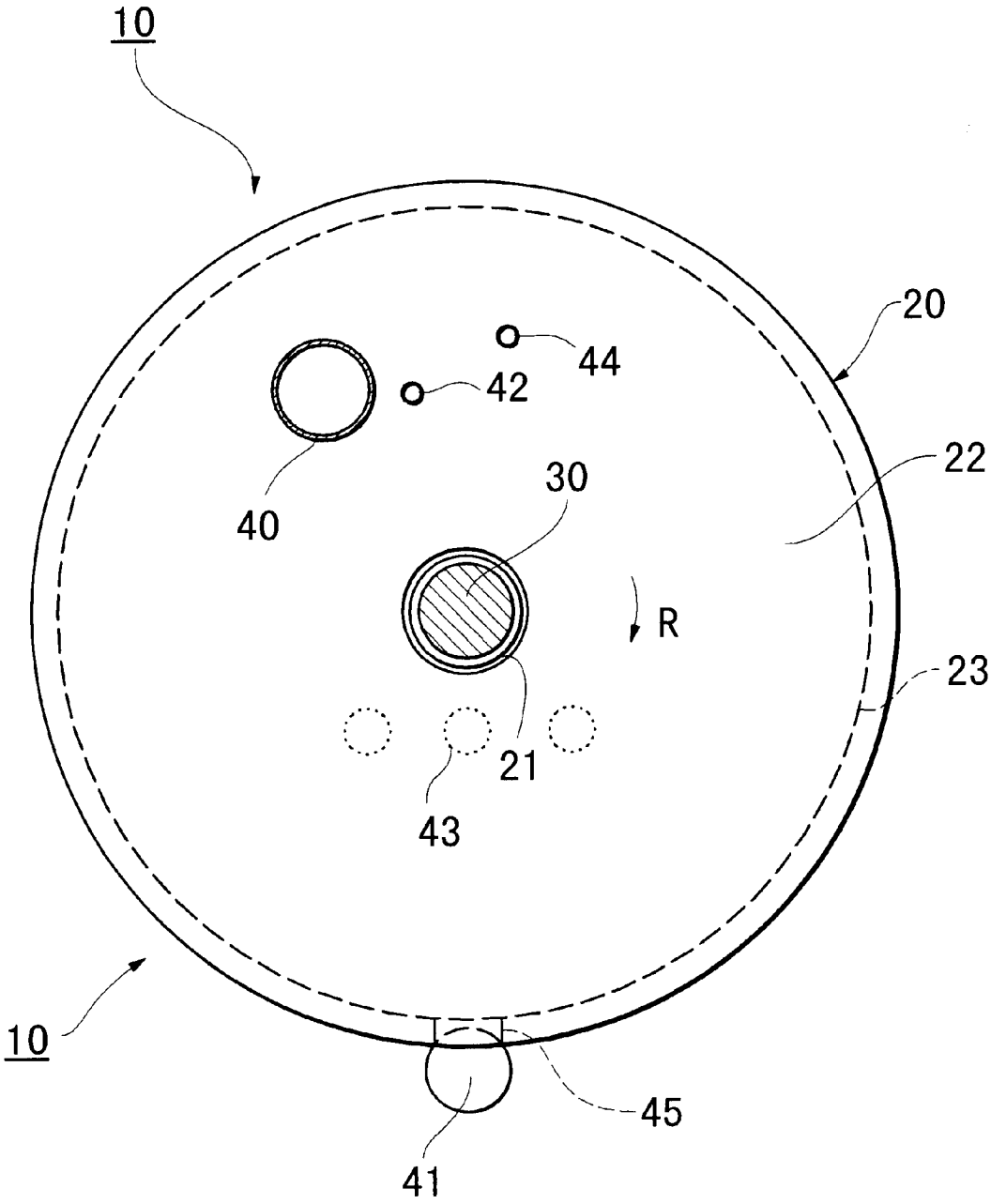
FIGS. 2 and 3 are plan and perspective views generally illustrating a mixer as shown in FIG. 1.
Figure 3:
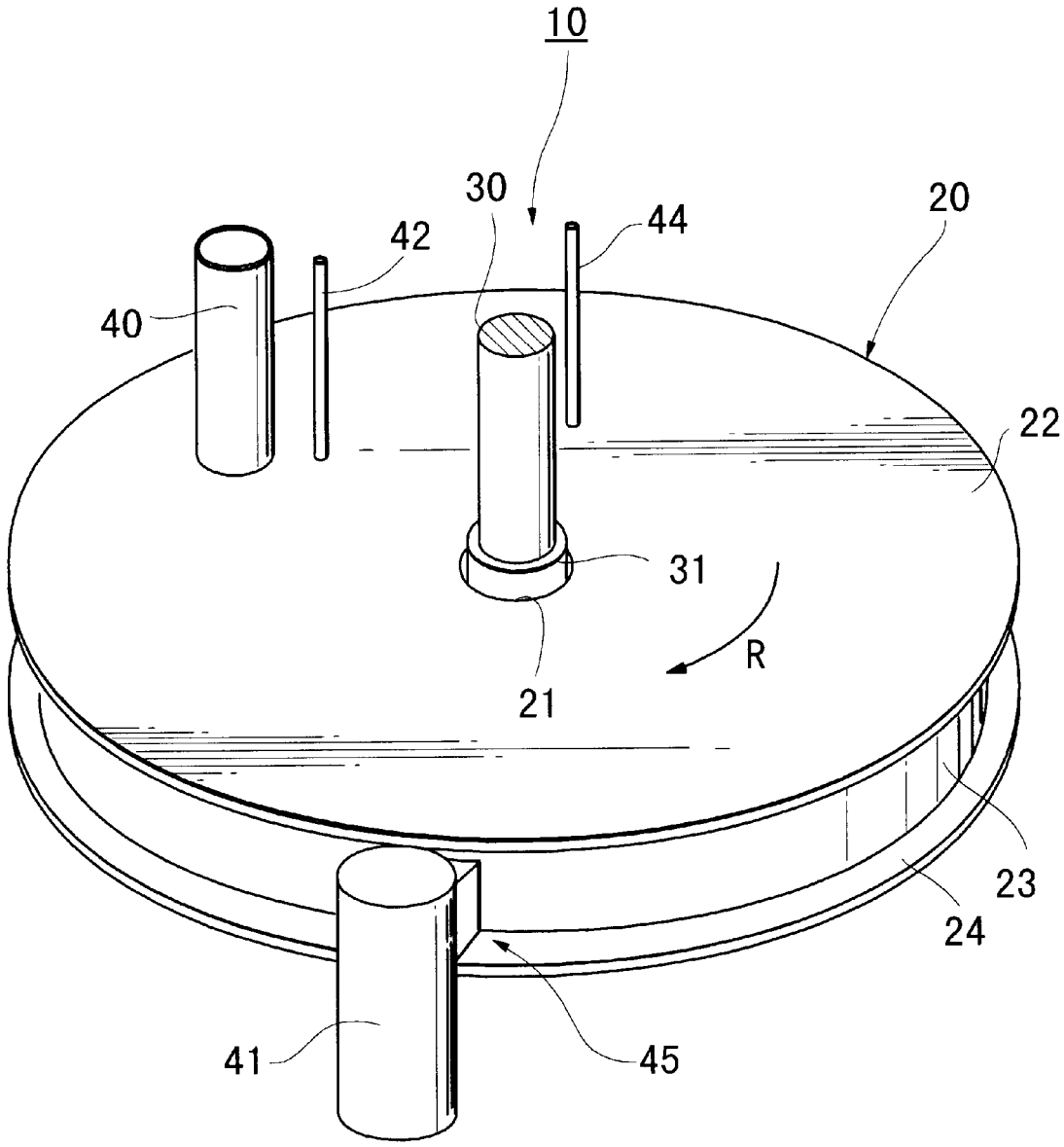

As shown in FIGS. 2 and 3, the mixer 10 has a relatively thin cylindrical housing or casing 20, which is formed with an upper plate or top cover 22, a lower plate or bottom cover 24, and an annular outer wall 23. The upper and lower plates 22, 24 in a circular disc-like form are vertically spaced apart a predetermined distance from each other, and the outer wall 23 is jointed to peripheral zones of the upper and lower plates 22, 24, respectively, The upper plate 22 is formed with a circular opening 21 at the center thereof, through which an enlarged bottom portion 31 of a rotatable vertical shaft 30 extends. The shaft 30 is operatively connected with suitable rotary drive means, such as an electric drive motor (not shown). If desired, a speed regulator, such as a transmission gear mechanism, a transmission belt assembly or the like, is interposed between the shaft 30 and an output shaft of the drive means. A powdered feedstock conduit 40 for feeding powdered materials to be mixed, a liquid feed conduit 42 for feeding a quantity of water to be mixed, pressure regulator means 43 for controlling the internal pressure (shown by dotted lines in FIG. 2), and further, a foam conduit 44 for introducing a quantity of foam into the mixed ingredients for regulating the volume of the slurry are connected to the upper plate 22 in predetermined positions, respectively. A slurry discharge conduit 41, which is in communication with the slurry feed pipe 12 (FIG. 1), is connected to the outer wall 23 by means of an outlet shute 45, which acts as slurry discharging means for introducing the slurry from the housing 20 into the slurry discharge conduit 41.

Figure 4:
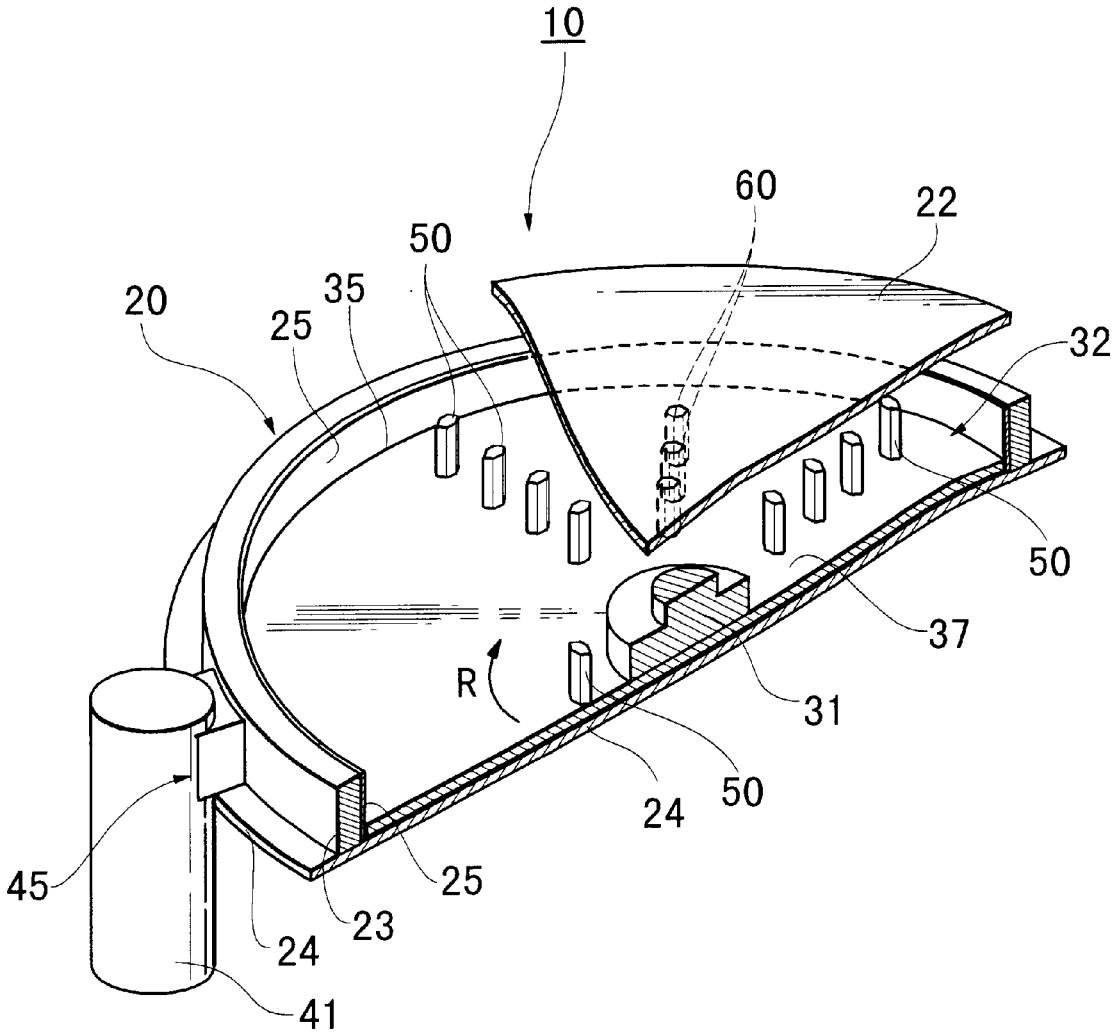
FIG. 4 is a fragmentary perspective view, party broken away, which illustrates internal structural arrangements of the mixer shown in FIGS. 1 to 3.
Figure 5:
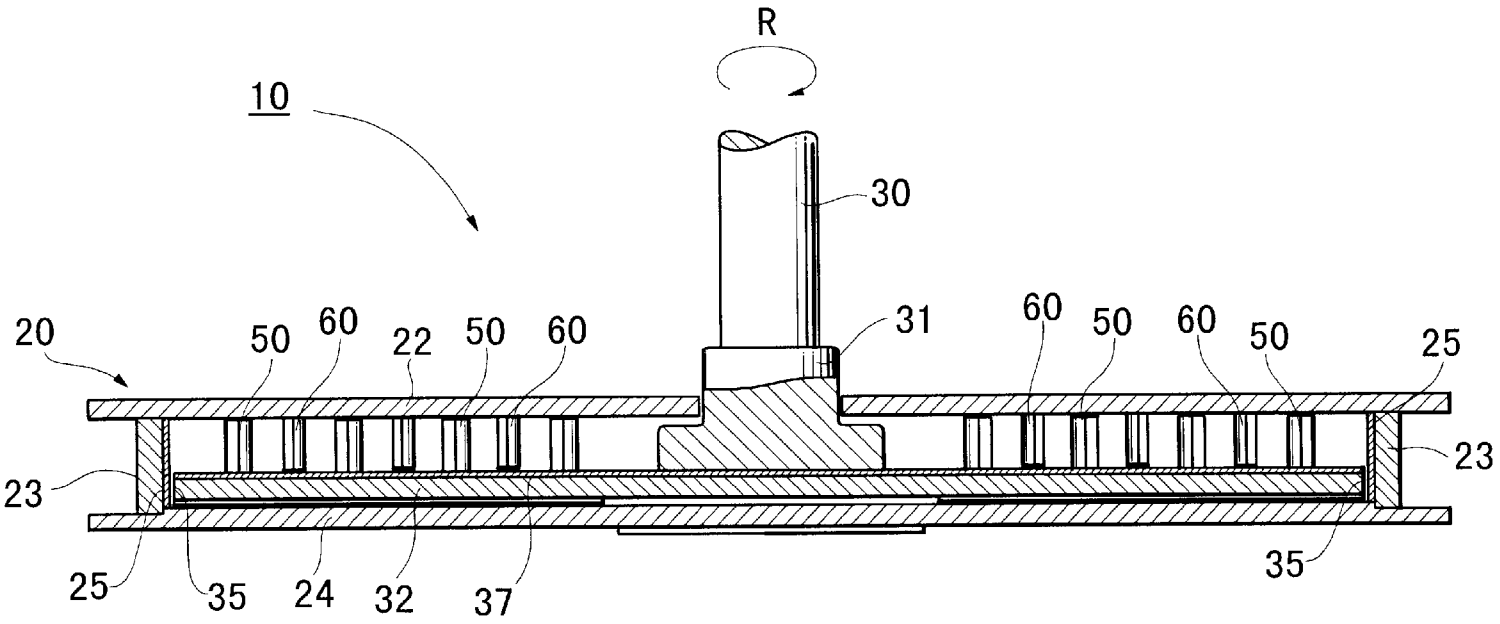
FIGS. 5 and 6 are vertical and horizontal cross-sectional views of the mixer as shown in FIGS. 1 to 4.
Figure 6:
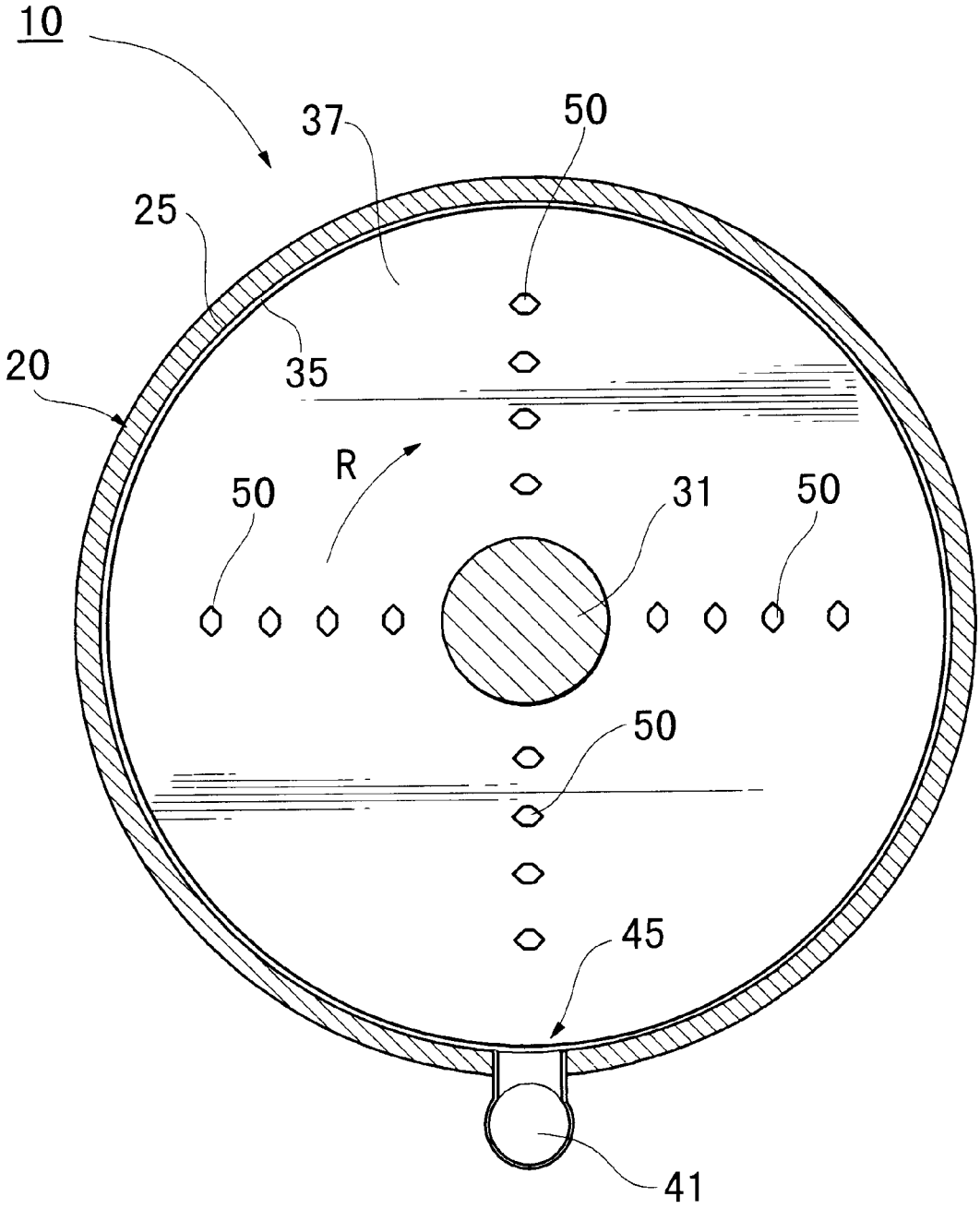

As shown in FIGS. 4 through 6, a rotary disc 32 is rotatably mounted within the housing 20, a center part of the disc 32 is fixedly secured to a lower surface of the enlarged bottom portion 31. A center axis of the disc 32 is aligned with a rotation axis of the shaft 30, and during operation of the mixer 10, the disc 32 is rotated integrally with the shaft 30 in a clockwise direction as indicated by an arrow R.

An upper surface of the disc 10 is covered with a planar structural element 37 made of a wear-resistant material. The disc 32, coaxial with the shaft 30, has an outer peripheral edge 35 configured to be a true round circle about the shaft 30 as seen from its upper side. An outer circumferential surface of the edge 35 is slightly spaced apart from an inner circumferential surface 25 of the outer wall 23, so that a small clearance or gap is provided between the surfaces 35, 25 to permit a rotational motion of the disc 32.

A plurality of lower pins 50, which act as movable pins, are vertically disposed on the upper surface of the disc 32. The lower pins 50 are arranged in rows between the periphery of the bottom portion 31 and the peripheral edge 35, spaced a predetermined distance from each other in a radial direction of the disc 32, whereby rows of pins substantially radially extending from the shaft 30 are provided on the disc 32. The respective rows of the lower pins 50 are positioned to be spaced a predetermined angle in the rotational direction R (the angle is set to be 90° in this embodiment). Further a plurality of upper pins 60, which act as stationary pins, depend from the upper plate 22. The upper pins 60 are arranged in a formation similar to the lower pins 50 so that the upper pins 60 form radial rows of pins which extend radially on the upper plate 22. The distance between the adjacent upper pins 60 is substantially identical with the distance between the adjacent lower pins 50, and therefore, the lower pins 50 are adapted to pass between the upper pins 60 when the pins 50 are moved in the direction R by rotation of the disc 32.

Figure 7:
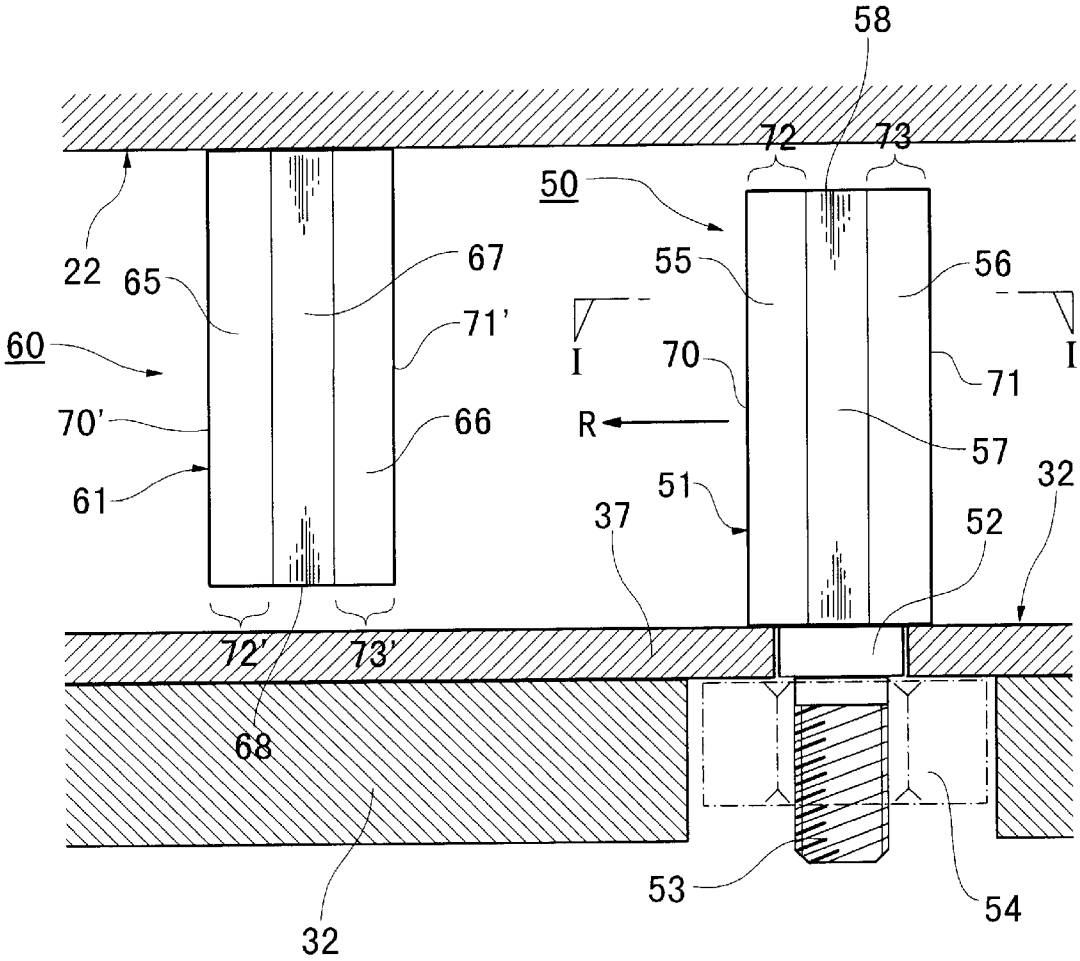
FIG. 7(A) is a side elevational view of the lower and upper pins as shown in FIGS. 4 to 6.
FIG. 7(B) is a cross-sectional view taken along line I—I of FIG. 7(A)
Figure 7:
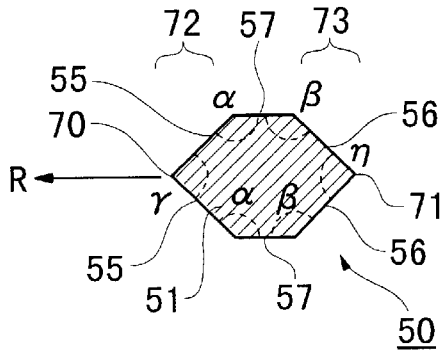

FIG. 7 includes a side elevational view and a transverse cross-sectional view showing the structures of the lower and upper pins 50, 60.

The lower pin 50 comprises a metallic body 51 upwardly projecting from the planar structural element 37 of the disc 32, a base portion 52 extending through the element 37, and a thread portion 53 extending downwardly from the base portion 52. A nut 54 as shown by phantom lines is fit on the thread portion 53 so that the lower pin 50 is fixedly secured on the planner structural element 37 by tightening the nut 54 on the thread portion 53.

The body 51, molded in a form of a hexagonal column, has the cross-sectional profile uniform throughout its entire height, which includes left and right front angled surfaces 55 which extend forward in the rotational direction R, left and right rear angled surfaces 56 which extend rearward in the direction R, left and right lateral surfaces 57 extending substantially parallel to the direction R, and a horizontal upper surface 58. The front and rear angled surfaces 55, 56 are inclined to the side surfaces 57 at predetermined angles $\alpha$, $\beta$, which are set to be a substantially equal angle in this embodiment, and therefore, the body 51 has a symmetrical configuration in both of its widthwise and lengthwise directions. The front angled surfaces 55 are joined together along a joint line 70 at a predetermined angle $\gamma$ therebetween, and the rear angled surfaces 56 are joined together along a joint line 71 at a predetermined angle $\eta$ therebetween. The joint lines 70, 71 are positioned on a center line of the body 51. In this embodiment, the angles $\alpha$, $\beta$ are set to be 135°, whereas the angles $\gamma$, $\eta$ are set to be 90°.

The lower pin 50 has the maximum width between the lateral surfaces 57 and the cross-sectional profile converging frontward and rearward in the rotational direction R, so that the pin 50 is generally configured in a streamlined form which is elongated in the rotational direction R to represent a relatively low fluid-resistance. The joint 70 and the front surfaces 55 define a frontward bulged portion 72, which is relatively sharp, to divide or split the gypsum slurry into two discrete streams on both sides of the body 51, whereas the joint 71 and the rear surfaces 56 define a rearward bulged portion 73 which is also relatively sharp to allow the slurry streams on both sides to smoothly join together.

Thus, the lower pins 50, which are fixed on the predetermined positions of the disc 32 as set forth above, have front and rear budged portions 72, 73 oriented in a tangential direction of a circle about the shaft 30.

The upper pins 60, which have substantially the same configuration as the lower pins 50 have, are fixed on a lower surface of the upper plate 22 in arrangements and positions similar to the lower pins 50 and downwardly projecting from upper plate 22 within the housing 20.

In FIG. 7(A), the upper pin 60 comprises a metallic body 61 formed in a hexagonal column with its cross-sectional profile being uniform over the entire height. The body 61 is provided with left and right front angled surfaces 65; left and right rear angled surfaces 66; left and right lateral surfaces 67; and a horizontal lower surface 68, wherein the front angled surfaces 65 are joined to each other at the angle $\gamma$ along a front joint line 70' and the rear angled surfaces 66 are joined to each other at the angle $\eta$ along a rear joint line 71'. The angled surfaces 65, 66 are joined to the lateral surfaces 67 at the angle $\alpha$ or $\beta$, respectively. The front surfaces 65 and the joint 70' define a frontward bulged portion 72', whereas the rear surfaces 66 and the joint 71' define a rearward bulged portion 73'.

A mode of operation of the above-mentioned pin mixer 10 with the disc 32 and the pins 50, 60 will be described hereinafter.

In operation of the rotary drive means, the disc 32 is rotated in the rotational direction R. The powdered ingredients including calcined gypsum, adhesion promoting agent, set accelerator, additives, intimate mixtures and the like, a quantity of water and a quantity of foam are introduced onto the disc 32 through the conduits 40, 42, 44, respectively. The rotary action of the disc 32 and the mixing action of the intermeshing pins 50, 60 allow the powdered materials, water and foam to be mixed together and agitated.

The lower pins 50 move in the fluidized mixture of the powdered materials, water and foam so that the fluid is displaced and deviated to both sides of the pin 50 by the front surfaces 55 of the bulged portion 72. The fluid relatively moves along the lateral surfaces 57 and the rear surfaces 56 backward of the pin 50, until the fluid streams join together in the rearward region behind the pin 50. Any retentive zone of the fluid, which may cause a vortex or turbulent fluid flow, is not provided behind the pin 50, as the rear bulged portion 73 occupies such a zone, and therefore, the deposition of the fluid on the rear face of the pin 50 is prevented from occurring.

The upper pin 60, which has substantially the same structure and configuration as the lower pin 50 has, acts or functions substantially in the same fashion of operation as that of the lower pin 50. However, the upper pin 60 differs from the lower pin 50 in that the rear bulged portion 73' of the pin 60 functionally corresponds to the front bulged portion 72 of the pin 50, and that the front bulged portion 72' of the pin 60 functionally correspond to the rear bulged portion 73 of the pin 50. Therefore, the front bulged portion 72' of the pin 60 occupies the region forward of the pin 60 in the rotational direction R so as not to form a retentive zone of fluid which may cause a vortex or turbulent fluid flow. Thus, the fluid can be prevented from depositing on the front face of the pin 60.

The fluid mixture of powdered materials, water and foam, which is admixed and agitated within the housing 20 by the rotation of the disc 32, is urged to move radially outward on the disc 32 under the action of the centrifugal force. The slurry moved to the peripheral zone of the disc 32 is introduced through the outlet shute 45 into the conduit 41 with mainly the rotary action and the centrifugal force of the disc 32 acting on the slurry in radially outward and cirumferential direction. As is mentioned above, the conduit 41 delivers the slurry for the slurry-disposing step through the conduit 12.

The disc 32 is provided with a peripheral edge having a circular profile, which differs from a toothed edge as in a conventional mixer, and therefore, substantially the rotary action and the centrifugal force of the disc 32 allow the slurry within the housing 20 to be introduced into the shute 45 to be delivered through the conduit 41. That is, any retentive zone of the slurry is not provided in the peripheral zone of the disc 32, and therefore, the slurry is not deposited on the periphery of the disc 32.

Figure 8:
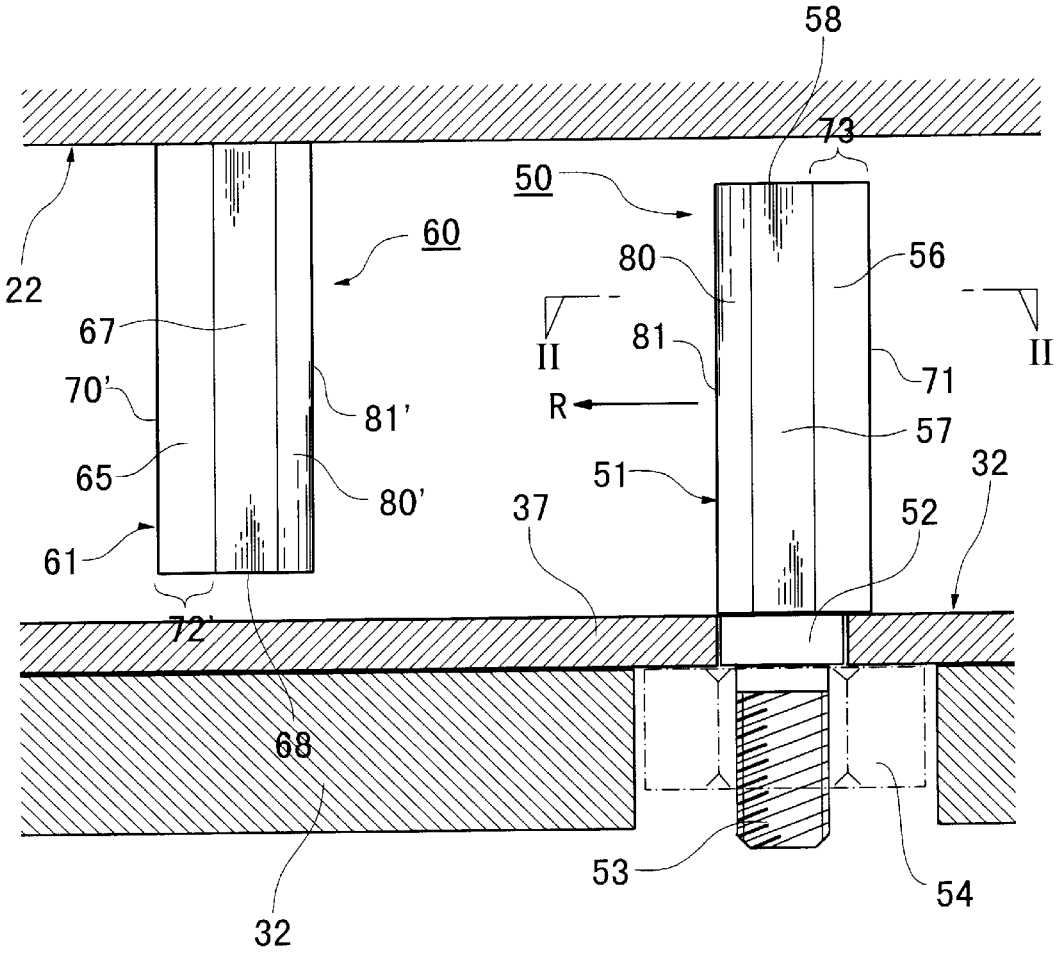
FIG. 8(A) is a side elevational view illustrating an alternative embodiment of the lower and upper pins.
FIG. 8(B) is a cross-sectional view taken along line II—II of FIG. 8(A)
Figure 8:
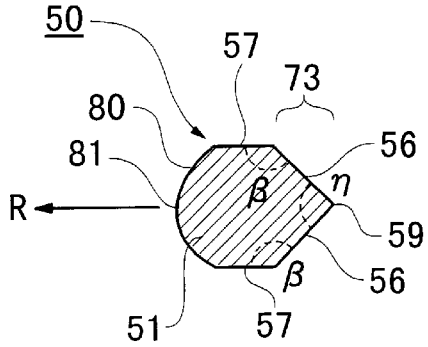
Figure 9:
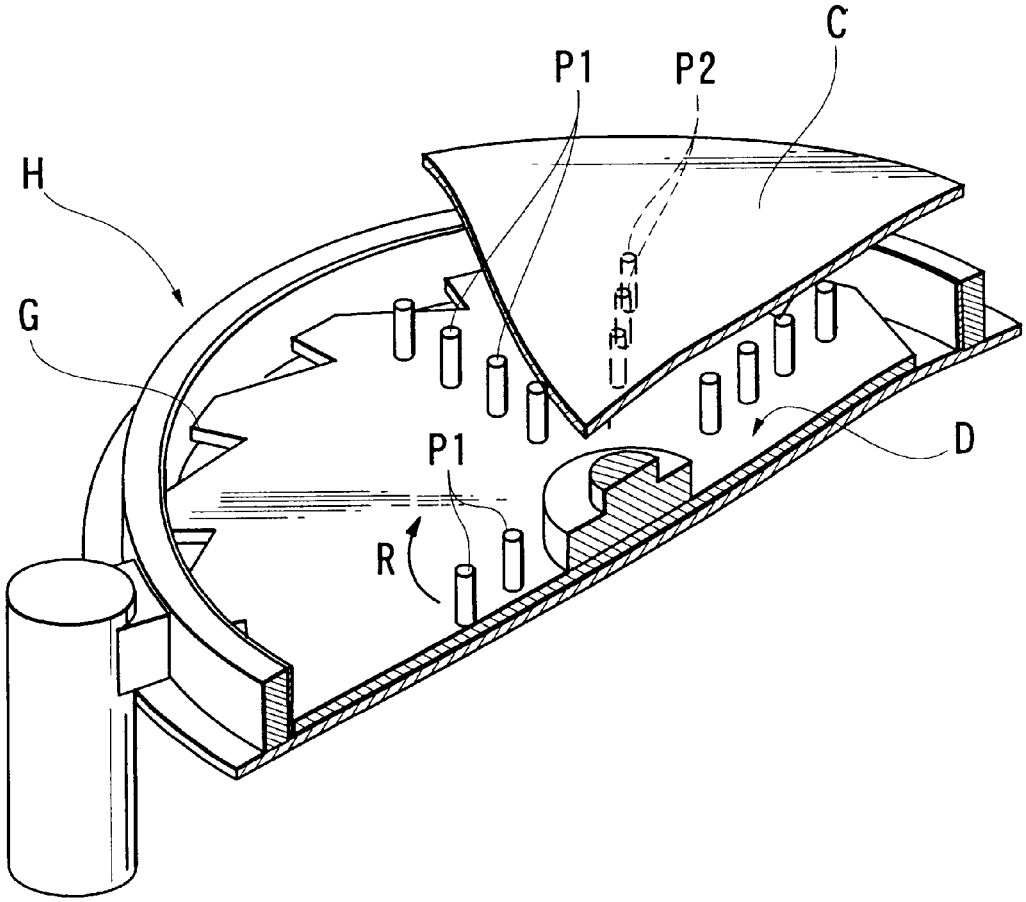
FIG.9 Prior Art
FIG. 9 is a fragmentary perspective view, partly broken away, which illustrates internal structural arrangements of a mixer conventionally in use.
Figure 10A:
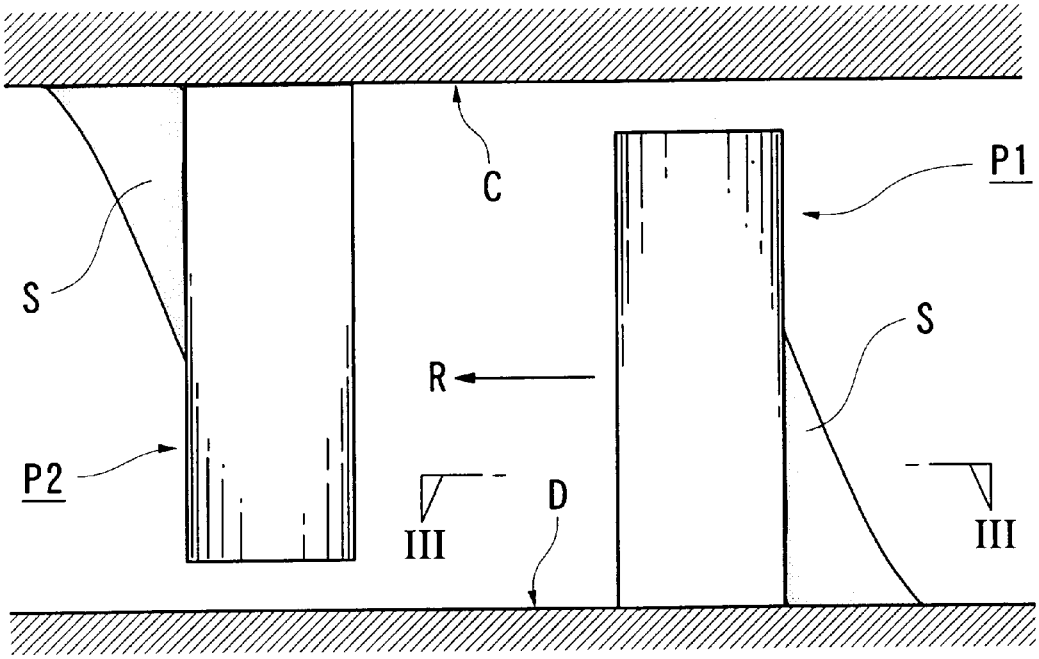
FIG.10A Prior Art
FIG. 10(A) is a side elevational view illustrating lower and upper pins arranged in the conventional mixer as shown in FIG. 9.
Figure 10B:
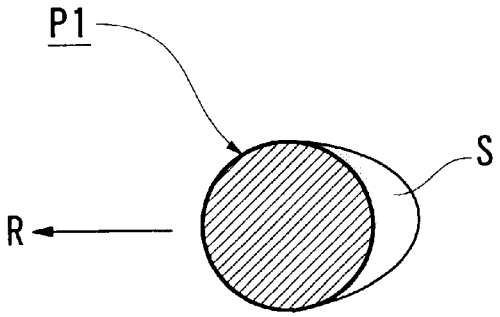
FIG.10B Prior Art
FIG. 10(B) is a cross-sectional view taken along line III—III of FIG. 10(A).

An alternative embodiment of the pins 50, 60 is illustrated on FIG. 8, which includes side elevational and cross-sectional views thereof. In FIG. 8, the means or constituents, which are substantially identical with or equivalent to those in the previous embodiment, are indicated by the same reference numerals as those in the previous embodiment.

The lower pin 50 as shown in FIG. 8 comprises a pin body 51, which has a uniform cross-section over its entire height, a base portion 52 and a thread portion 53, and the body 51 is provided with a horizontal upper surface 58, left and right rear angled surfaces 56 and side surfaces 57, as in the aforementioned embodiment. However, the pin 50 shown in FIG. 8 differs therefrom in that the pin 50 has a front round surface 80 smoothly curved in a predetermined radius of curvature, a frontmost part 81 of the surface 80 being positioned on a center line of the body 51.

The lower pins 50 move in the rotational direction R with the rotation of the disc 32. The powdered materials, water and foam, or the slurry are displaced and deviated on both sides of the pin 50 by the curved surface 80, and are relatively moved along the lateral surfaces 57 and the rear angled surfaces 56 backward of the pin 50, and then, are allowed to join together in the rearward area of the pin 50. Similarly to the lower pin shown in FIG. 7 of the aforementioned embodiment, the retentive zone, which may cause vortex or turbulent flow, is not formed behind the pin 50, since the rear bulged portion 73 exists therein, and therefore, deposition of the fluidic matter on the rear or back face of the pin 50 is avoidable.

This configuration of the pin 50 is applicable to the upper pin 60 with the bulged portion 72' and the joint 70', in which the curved surface 80' of the pin 60 with the extremity 81' is, however, positioned on its rear side (backward side of the pin 60 as seen in the rotational direction R). The pin body 61 has the front angled surfaces 65 formed in front of the upper pin 60 (forward side in the rotational direction R) and the lateral surfaces 67 formed on both sides thereof.

According to the aforementioned embodiments, the mixer 10 comprises the disc 32 having the peripheral edge 35, which is formed in the circular profile concentric with the inner circumferential surface 25 of the annular outer wall 23; the lower pins 50 provided with the rear bulged portions 73 which extend backward of the rotational direction R; and the upper pins 60 provided with the front bulged portion 72' which extends forward of the rotational direction R. The disc 32 without a toothed formation on its peripheral edge zone can prevent the slurry from depositing on the peripheral zone of the disc 32. Further, the rear and front bulged portions 73, 72' occupy the rearward area of the lower pin 50 and the forward area of the upper pin 60 so as not to provide the retentive regions of the slurry, which might otherwise have caused a vortex or turbulent flow of the slurry. Accordingly, the deposition of the slurry on the lower and upper pins 50, 60 can be prevented from occurring.

It is apparent that further modifications may be made as to the above-described embodiments. For instance, the angled surfaces 55, 56 may be modified to have curved surfaces which are streamlined to be prolonged in the rotational direction R; or otherwise, the upper and lower pins 50, 60 are generally formed to have an ellipse, rhombus, or streamline cross-section. In such modifications, the longitudinal axis of the cross-sectional profile is oriented along the rotational direction R so that the front and rear faces of the pins 50, 60 are provided with frontward and rearward bulged portions to occupy the retentive regions of the fluidized matter, thereby eliminating such retentive regions. If desired, the pins 50, 60 having the aforementioned configuration may be disposed in a limited area of the disc 32 and the housing 20 so that the pins 50, 60 and conventional pins are appropriately intermingled in the housing 20.

It is understood, therefore, that this invention is not to be limited to the particular embodiments shown and described above, since many modifications may be made, and it is contemplated by the appended claims to cover such modifications as fall within the true spirit and scope of this invention.

We claim:

1. A mixer comprising a housing into which a powdered material and a quantity of water is introduceable, a rotary disc rotatably mounted within the housing, a plurality of lower pins fixedly secured on the disc substantially vertically, and a plurality of upper pins fixedly secured on a lower surface of an upper cover of the housing, so as to admix and agitate the powdered material with the water to produce a gypsum slurry, wherein said lower pins are provided with a rear bulged portion expanding rearward in a rotational direction of the disc, said bulged portion extending rearward in the rotational direction so as to allow the slurry to move backward along lateral surfaces of said lower pins and the lateral surfaces being joined together with each other so as to allow the slurry to rejoin together behind said lower pins.

2. A mixer as defined in claim 1 wherein a peripheral edge of said disc has a circular profile concentric with a circumferential inside wall surface of an annular outer wall of said housing.

3. A mixer as defined in claim 2 wherein said upper pins are provided with a front bulged portion expanding frontward in a rotational direction of the disc, said front bulged portion extending frontward in the rotational direction so as to allow the slurry to move forward along lateral surfaces of said upper pins and the lateral surfaces thereof being joined together with each other so as to allow the slurry to rejoin together in front of said upper pins.

4. A mixer comprising a housing into which a powdered material and a quantity of water is introduceable, a rotary disc rotatably mounted within the housing, a plurality of lower pins fixedly secured on the disc substantially vertically, and a plurality of upper pins fixedly secured on a lower surface of an upper cover of the housing, so as to admix and agitate the powdered material with the water to produce a gypsum slurry, wherein said upper pins are provided with a front bulged portion expanding frontward in a rotational direction of the disc, said bulged portion extending frontward in the rotational direction so as to allow the slurry to move forward along lateral surfaces of said upper pin and the lateral surfaces being joined together with each other so as to allow the slurry to smoothly rejoin together in front of said upper pins.

5. A mixer as defined in claim 4 wherein said lower pins are provided with a rear bulged portion expanding rearward in a rotational direction of the disc, said rear bulged portion extending rearward in the rotational direction so as to allow the slurry to move backward along lateral surfaces of said lower pin and the lateral surfaces thereof being joined together with each other so as to allow the slurry to rejoin together behind said lower pins.

6. A mixer as defined in claim 4 wherein a peripheral edge of said disc is has a circular profile concentric with a circumferential inside wall surface of an annular outer wall of said housing.

7. A mixer comprising a housing into which a powdered material and a quantity of water is introduceable, a rotary disc rotatably mounted within the housing, a plurality of lower pins fixedly secured on the disc substantially vertically, and a plurality of upper pins fixedly secured on a lower surface of an upper cover of the housing, so as to admix and agitate the powdered material with the water to produce a gypsum slurry, wherein said lower pins are provided with a rear bulged portion expanding rearward in a rotational direction of the disc, said bulged portion extending rearward in the rotational direction so as to allow the slurry to move backward along lateral surfaces of said lower pins, wherein said lower pins have a pair of said lateral surfaces defining planes substantially parallel to the rotational direction of said disc, and angled surfaces inclined to said lateral surfaces at a predetermined angle to extend rearward in the rotational direction, and wherein the angled surfaces on both sides in pair are jointed to each other at a predetermined angle to form said rear bulged portion and allow the slurry to rejoin together behind the lower pins.

8. A mixer as defined in claim 7 wherein a peripheral edge of said disc is configured to be a circular profile concentric with a circumferential inside wall surface of an annular outer wall of said housing.

9. A mixer comprising a housing into which a powdered material and a quantity of water is introduceable, a rotary disc mounted within the housing, a plurality of lower pins fixedly secured on a lower surface of an upper cover of the housing, so as to admix and agitate the powdered material with the water to produce a gypsum slurry, wherein said upper pins are provided with a front bulged portion expanding frontward in a rotational direction of the disc, said bulged portion extending frontward in the rotational direction so as to allow the slurry to move forward along lateral surfaces of said upper pins, wherein said upper pins have a pair of said lateral surfaces defining planes substantially parallel to the rotational direction of said disc, and angled surfaces inclined to said lateral surfaces at a predetermined angle to extend frontward in the rotational direction, and wherein the angled surfaces on both sides in pair are jointed to each other at a predetermined angle to form said front bulged portion so as to allow the slurry to rejoin together in front of the upper pins.

10. A mixer as defined in claim 9 wherein said lower pins are provided with a rear bulged portion expanding rearward in a rotational direction of the disc, said rear bulged portion extending rearward in the rotational direction so as to allow the slurry to move backward along lateral surfaces of said lower pins, wherein said lower pins have a pair of the lateral surfaces defining planes substantially parallel to the rotational direction of said disc, and angled surfaces inclined to the lateral surfaces at a predetermined angle to extend rearward in the rotational direction, and wherein the angled surfaces on both sides in pair are jointed to each other at a predetermined angle to form said rear bulged portion and allow the slurry to rejoin together behind the lower pins.

11. A mixer as defined in claim 10 wherein a peripheral edge of said disc has a circular profile concentric with a circumferential inside wall surface of an annular outer wall of said housing.

12. A mixer as defined in claim 9 wherein a peripheral edge of said disc has a circular profile concentric with a circumferential inside wall surface of an annular outer wall of said housing.

13. A mixer comprising a housing into which a powdered material and a quantity of water is introduceable, a rotary disc rotatably mounted within the housing, a plurality of lower pins fixedly secured on the disc substantially vertically, and a plurality of upper pins fixedly secured on a lower surface of an upper cover of the housing, so as to admix and agitate the powdered material with the water to produce a gypsum slurry, wherein said lower pins have a cross-sectional profile formed in a hexagonal configuration that is elongated in the rotational direction of said disc and symmetric with respect to the axis extending in said rotational direction, so that the slurry moves backward along lateral surfaces of said lower pins and rejoins together behind the lower pins.

14. A mixer as defined in claim 13 wherein a peripheral edge of said disc is configured to be a circular profile concentric with a circumferential inside wall surface of an annular outer wall of said housing.

15. A mixer comprising a housing into which a powdered material and a quantity of water is introduceable, a rotary disc rotatably mounted within the housing, a plurality of lower pins fixedly secured on the disc substantially vertically, and a plurality of upper pins fixedly secured on a lower surface of an upper cover of the housing, so as to admix and agitate the powdered material with the water to produce a gypsum slurry, wherein said upper pins have a cross-sectional profile formed in a hexagonal configuration that is elongated in the rotational direction of said disc and symmetric with respect to the axis extending in said rotational direction, so that the slurry moves forward along lateral surfaces of said upper pins and rejoins together in front of the upper pin.

16. A mixer as defined in claim 15 wherein said lower pins have a cross-sectional profile formed in a hexagonal configuration that is elongated in the rotational direction of said disc and symmetric with respect to the axis extending in said rotational direction, so that the slurry moves backward along lateral surfaces of said lower pins and rejoins together behind the lower pins.

17. A mixer as defined in claim 16 wherein a peripheral edge of said disc has a circular profile concentric with a circumferential inside wall surface of an annular outer wall of said housing.

18. A mixer as defined in claim 15 wherein a peripheral edge of said disc has a circular profile concentric with a circumferential inside wall surface of an annular outer wall of said housing.

19. A mixer comprising a housing into which a powdered material and a quantity of water is introduced, a rotary disc rotatably mounted within the housing, a plurality of lower pins fixedly secured on the disc substantially vertically, and a plurality of upper pins fixedly secured on a lower surface of an upper cover of the housing, so as to admix and agitate the powdered material with the water to produce a gypsum slurry, wherein said lower pins are provided with a rear bulged portion expanding rearward in a rotational direction of the disc, said bulged portion extending rearward in the rotational direction so as to allow the slurry to move backward along lateral surfaces of said lower pins, wherein said lateral surfaces are formed in a pair of left and right curved surfaces, each having a predetermined radius of curvature, and said curved surfaces extend from the part of the lower pin having a maximum dimension in a direction perpendicular to the rotational direction, and wherein a cross-sectional profile of the curved surfaces is configured in a parabolic shape or streamlined shaped and the curved surfaces are joined together with each other in the rear of the lower pins in the rotational direction so as to allow the slurry to smoothly rejoin together behind the lower pins.

20. A mixer as defined in claim 19 wherein a peripheral edge of said disc has a circular profile concentric with a circumferential inside wall surface of an annular outer wall of said housing.

21. A mixer comprising a housing into which a powdered material and a quantity of water is introduceable, a rotary disc rotatably mounted within the housing, a plurality of lower pins fixedly secured on the disc substantially vertically, and a plurality of upper pins fixedly secured on a lower surface of an upper cover of the housing, so as to admix and agitate the powdered material with the water to produce a gypsum slurry, wherein said upper pins are provided with a front bulged portion expanding frontward in a rotational direction of the disc, said bulged portion extending frontward in the rotational direction so as to allow the slurry to move forward along lateral surfaces of said upper pins, wherein said lateral surfaces are formed in a pair of left and right curved surfaces, each having a predetermined radius of curvature, and said curved surfaces extend from the part of the upper pins having a maximum dimension in a direction perpendicular to the rotational direction, and wherein a cross-sectional profile of the curved surfaces is configured in a parabolic shape or streamlined shape and the curved surfaces are joined together with each other in front of the upper pins in the rotational direction so as to allow the slurry to smoothly rejoin together in front of the upper pins.

22. A mixer as defined in claim 21 wherein said lower pins are provided with a rear bulged portion expanding rearward in a rotational direction of the disc, said rear bulged portion extending rearward in the rotational direction so as to allow the slurry to move backward along lateral surfaces of said lower pins, wherein the lateral surfaces are formed in pair of left and right curved surfaces, each having a predetermined radius of curvature, and the curved surfaces extend from a part of the lower pins having a maximum dimension in a direction perpendicular to the rotational direction, and wherein a cross-sectional profile of the curved surfaces is configured in a parabolic shape or streamlined shape and the curved surfaces are joined together with each other in the rear of the lower pins in the rotational direction so as to allow the slurry to rejoin together behind the lower pins.

23. A mixer as defined in claim 22 wherein a peripheral edge of said disc has a circular profile concentric with a circumferential inside wall surface of an annular outer wall of said housing.

24. A mixer as defined in claim 21 wherein a peripheral edge of said disc has a circular profile concentric with a circumferential inside wall surface of an annular outer wall of said housing.

* * * * *